US006199857B1

(12) United States Patent
Lien

(10) Patent No.: US 6,199,857 B1
(45) Date of Patent: Mar. 13, 2001

(54) I. D. CARD OUTPUT STACKER

(75) Inventor: Brent D. Lien, Minneapolis, MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/401,637

(22) Filed: Sep. 22, 1999

(51) Int. Cl.[7] ..... B65H 29/44

(52) U.S. Cl. ..... 271/180; 271/181; 271/212; 414/795.3

(58) Field of Search ..... 271/212, 180, 271/177, 181; 414/795.3

(56) References Cited

U.S. PATENT DOCUMENTS

| | | | |
|---|---|---|---|
| 1,210,440 | 1/1917 | Elliott . | |
| 1,671,790 | 5/1928 | Staude . | |
| 1,960,667 | 5/1934 | Hutt et al. | 271/87 |
| 2,248,122 | 7/1941 | Rosenthal | 271/87 |
| 2,595,346 | 5/1952 | Federwitz | 271/87 |
| 3,771,670 | 11/1973 | Napoleone et al. | 214/6 |
| 3,870,166 | 3/1975 | Tull, III | 214/6 |
| 4,406,572 | 9/1983 | Karcher | 414/404 |
| 4,463,942 | 8/1984 | Newsome | 271/12 |
| 4,512,263 * | 4/1985 | Lanning | 271/181 X |
| 4,588,179 | 5/1986 | Gutierrez | 270/58 |
| 4,684,308 * | 8/1987 | Dormer | 414/795.3 |
| 5,415,519 * | 5/1995 | Lee et al. | 414/795.3 |
| 5,551,834 * | 9/1996 | Thompson et al. | 271/180 X |
| 5,904,466 | 5/1999 | Miller et al. | 414/796.7 |

* cited by examiner

*Primary Examiner*—David H. Bollinger
(74) *Attorney, Agent, or Firm*—Westman, Champlin & Kelly, P.A.

(57) ABSTRACT

An output card hopper for use in connection with an identification card printer as a hopper that receives the cards and permits the cards to be supported on movable lift rails. The rails can be moved up and down, and the hopper has a pair of pawls that extend into the hopper from the sides and which are retracted as the card is lifted up by the lift rails, and then permitted to move back inwardly so that as the card support is lowered, the card that had been carried up by the rails is supported on the pawls in a stack above the pawls. The hopper includes one adjustable side wall to permit adjusting the width of the hopper. The card lift rails are raised and lowered by operating a cam, with a spring return on the card lift rails to urge the lift rails toward a home or lowered position.

20 Claims, 9 Drawing Sheets

I. D. CARD OUTPUT STACKER

BACKGROUND OF THE INVENTION

The present invention relates to a stacker for printed identification cards that receives printed cards from a printer and stacks them so that they are oriented in sequence, with the first printed for the particular batch being at the top of the stack in the stacker.

Various stackers of ticket and similar small dimension items have been advanced in the past, utilizing supports for a stack of items that are supported in a housing. The stack is pushed upwardly and retained in a raised position while other ones of the items are placed underneath. However, in the I.D. card printer art, the need has existed to rapidly, and precisely stack the printed cards so that in the stacking cards, the first printed is oriented at the top in order to keep adequate records and correlate the printed cards to information that relates to the party that is identified by the card. Thus, a very reliable stacker is needed and having the stack in order such that the first printed is at the top of the stack greatly simplifies the record keeping capabilities.

SUMMARY OF THE INVENTION

The present invention is a high speed, reliable stacker for relatively rigid plastic identification cards that have been printed in a printer and when ejected from the printer will be received by the stacker and formed into a sequential stack with the first printed or the first received at the top of the stack and the last received at the bottom of the stack.

The stacker of the present invention utilizes a simplified drive and stack holding mechanism that is reliable and which operates fast. The cards are received on a card lift platform that includes a pair of narrow rails adjacent the edges of the card. The narrow support rails reduce the friction that is present between the cards and the card lift. After receiving a card a suitable signal is given for operating the card lift that, in the form shown, is a smooth acting rotating cam that operates directly on portions of the platform assembly, and which raises the card supported on the lift above a pair of pawls that extend in from the sides of a card hopper for holding the stack in a first position. The pawls are retracted as the card lift is raised. When the card that is being lifted engages the stack and supports it so that the card being lifted is above the level of the pawls. The pawls are released and will snap into place under a spring load and protrude sufficiently so that when the card lift is lowered, the card that had been raised above the pawls, and any cards in the stack above that card will be held by the pawls as part of the stack.

If there is a stack of cards supported on the top edges of the pawls when a new card is introduced, the card that is being raised will engage the lower card and the card lift will lift the entire stack within the confines of the hopper. The stack will then be held on the pawls when the card lift platform is lowered again.

The card hopper has one wall that it can be adjusted to accommodate different size I.D. cards very easily. The operation is simple, and because cams are used specifically that act directly against a surface forming a portion of the card lift platform assembly, the raising and lowering can be done very rapidly.

Thus, an output stacker for a high speed printer is available with reliable, simple operation, without parts that involve complex operations or lifting and lowering devices.

DETAILED DESCRIPTION OF THE ILLUSTRATIVE EMBODIMENTS

Figure 2:
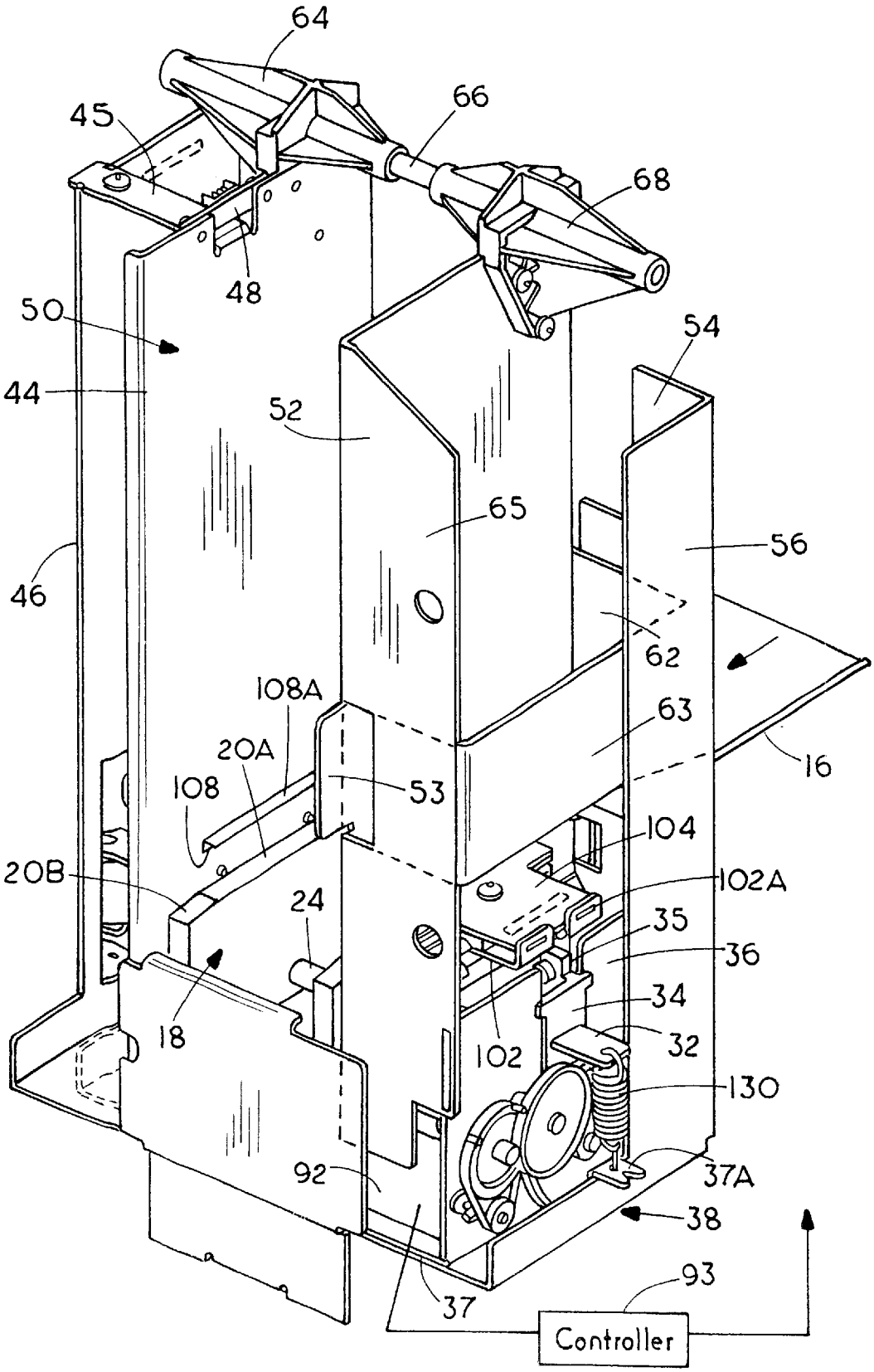
FIG. 2 is a perspective view of the hopper of FIG. 1 shown in the foreground an output end of the hopper.
Figure 3:
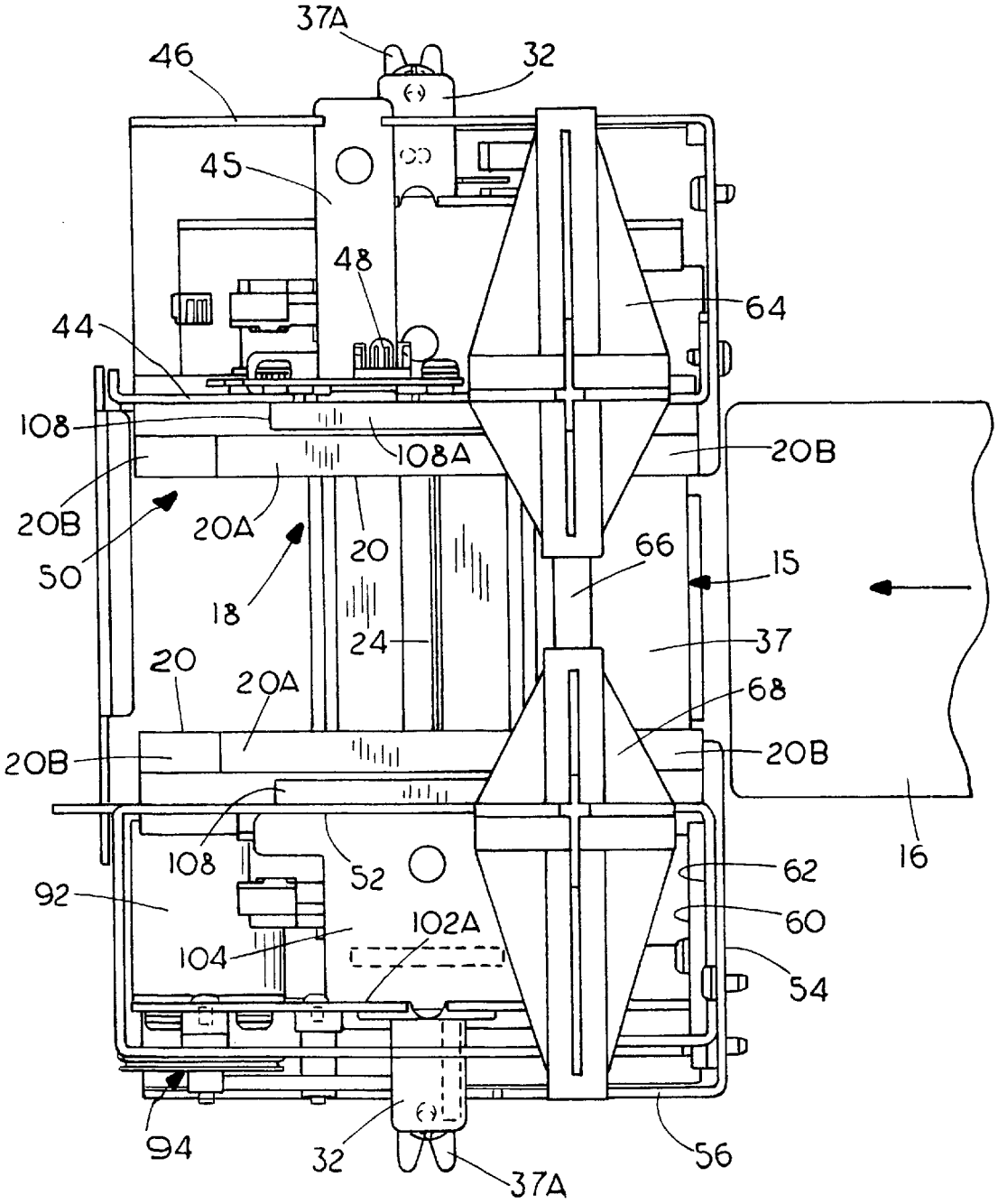
FIG. 3 is a top plan view of the hopper of FIG. 1.

A printer output I.D. card stacker indicated generally at 10 is provided on an output side of a printer 12, that is shown only schematically. Identification card printers are used widely for printing personal identification information, such as pictures, height, weight, other identification characteristics and access codes onto a plastic card. When the card is printed, it is driven by a card drive, generally drive rollers such as those shown at 14 to an output side of the printer 12. A card 16, as shown, is then fed into a card entry opening 15 of the card stacker 10 of the present invention. As shown in FIG. 2, when the card 16 is fed it is supported on a card support and lift assembly 18 that includes a pair of side card lift rails 20, 20. The side rails 20, 20 have narrow upper surfaces 20A, and have tapered ends 20B for guiding a card onto and off the top surfaces 20A of the rails 20.

Figure 1:
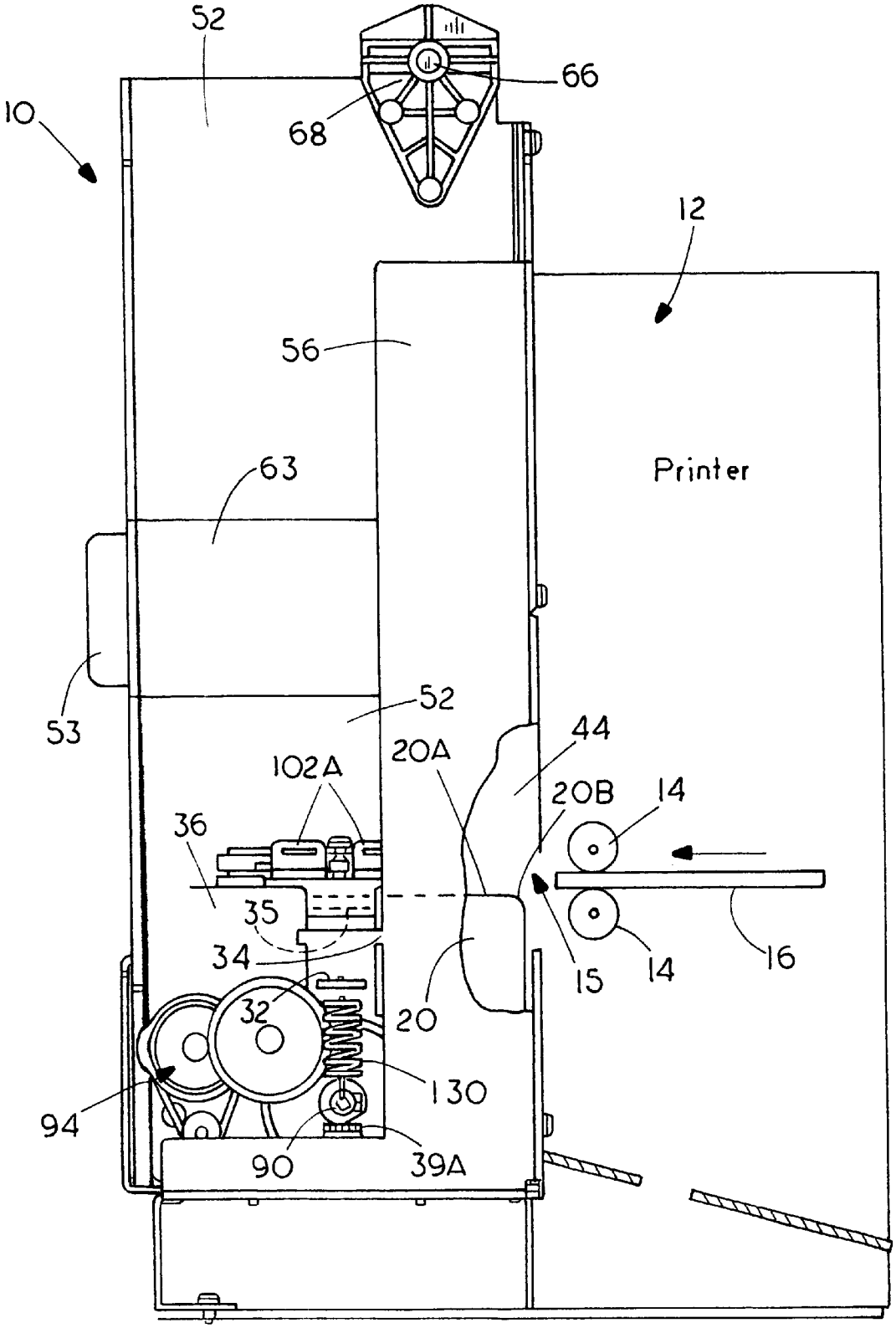
FIG. 1 is a side elevational view of a stacking hopper having a card stacker made according to the present invention installed therein.

The side lift rails 20, 20 forming part of the assembly 18 are joined together with a cross frame 22 that has an irregular configuration, and includes a support shaft 24 that is supported in vertical upright members 26. The upright members 26 are integrally formed with a cross base or cam plate 28. The cross cam plate 28 has downwardly depending flanges 30 for strengthening at the front and rear of the plate 28. The cross frame 22 also has horizontally extending flanges 32 at the opposite sides thereof which are supported in guide bushings 34. The bushings 34 in turn are slidably guided in provided slots 35, (see FIGS. 1 and 2) in upright walls 36 that form guides and supports for the card platform assembly 18. The walls 36 are formed integrally with a cross wall 37 that is attached to a base frame 38 of the card stacker.

The card stacker 10 has a card hopper 50 formed with a fixed side upright guide wall 44 that is supported on the frame 38 in a suitable manner. It can be seen that the frame 38 includes an upright support wall 46, as shown in FIG. 2 as well. The top of fixed guide wall 44 of the card hopper 50 is braced to the wall 46 with a cross brace 45 to form a stable support. A card stack sensor 48, which is a hopper full sensor, provides a signal indicating when the card hopper 50 is full. The opposite side of the card hopper 50 has a laterally (width) adjustable wall 52. Wall 52 is suitably supported on a flange or section 54 of an upright wall 56 that is similar to the wall 46. The flange 54 supports a stud 58 (see FIG. 4 for example) on which a low friction material slide 60 is suitably slidably mounted. The slide 60 has a slot 60A through which the stud 58 extends. The slide 60 is fixed to a lateral flange 62 that is attached to the guide wall 52 for the hopper. The flange 62 is joined with a strap 63 that joins a flange 65 formed at right angles to wall 52. A tab 53 is provided on side wall 52 for manually adjusting the wall.

The hopper side wall 52 can be suitably supported so that it is slidable laterally of the frame 38 relative to the wall 44 forming the other side of the hopper 50.

At the top of the card hopper 50, the fixed wall 44 has a pillow block 64 mounted thereon, and the pillow block 64 supports a shaft 66 that extends laterally across the top of the hopper. An adjustment bushing 68 is slidably mounted on the shaft 66 on the opposite side of the shaft from the pillow block 64. The adjustment bushing 68 is fixed to the side wall 52, as can be seen in FIG. 2 as well. The bushing 68 will slide along the shaft 66 with some drag, so that it will stay in position on the shaft 66 but the wall 52 can be adjusted laterally to desired position for different size cards. The slide 60 provides support, and other slides can be used for supporting wall 52 as desired.

Figure 4:
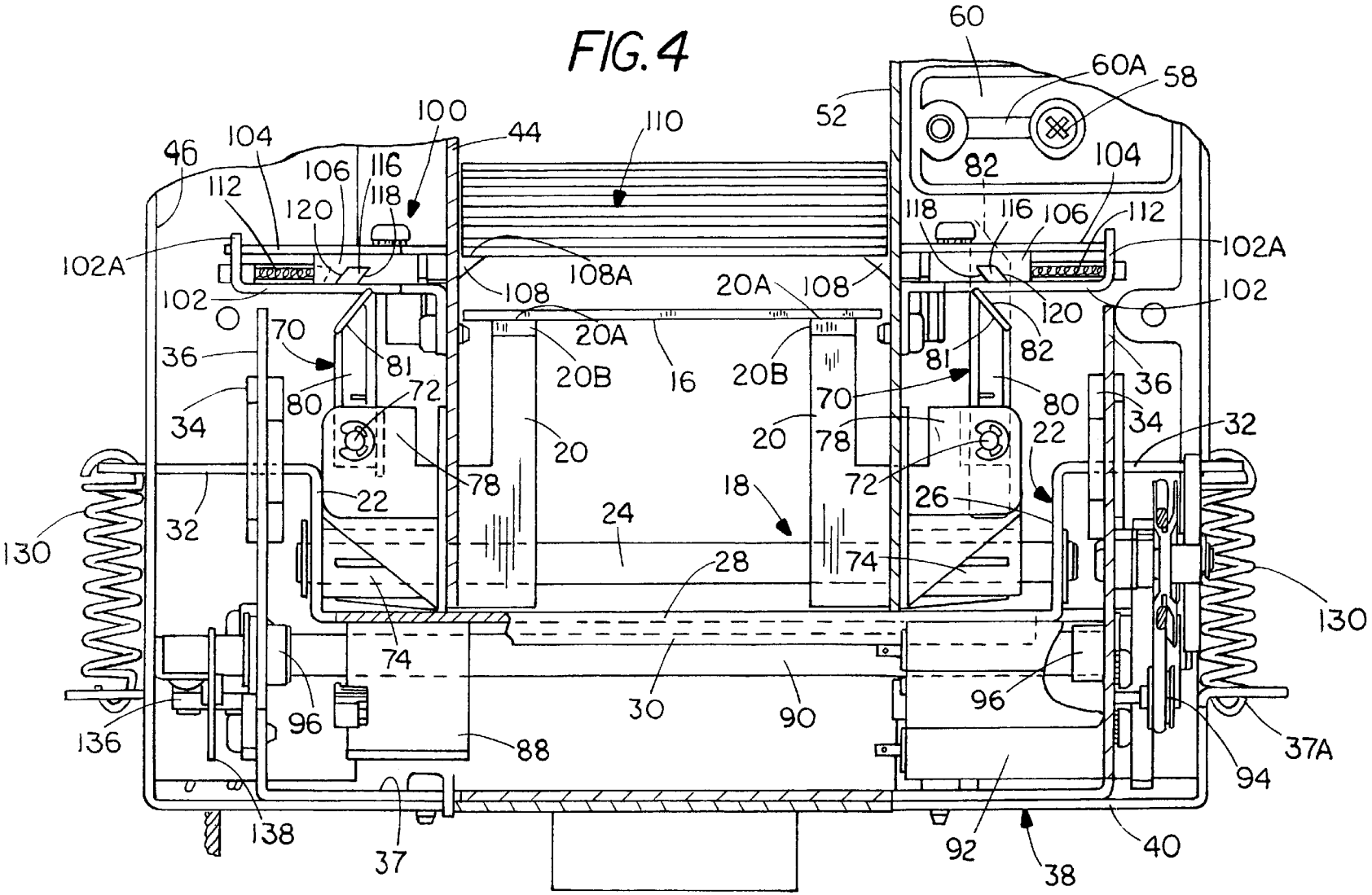
FIG. 4 is an enlarged sectional view from an output side of the hopper showing the card lift platform in a lowered or "home" position.

FIG. 4 illustrates the card support frame and rails 20 in a home or lowered position where they are in a position to receive the card 16 that has just been printed by the printer 12.

As shown, the card fits between the side walls 44 and 52, with small clearance, so that all the cards 16 are guided as they are moved in between the hopper walls. The cards 16 slide into the hopper above the lift rails 20 and then are supported on the rails. The frame uprights 22 carry shaft 24 and the lift rails 20. The frame 18 carries a support block 74 on each side of the hopper, which blocks 74 are integral with the rails 20 and slide in vertical slots in walls 44 and 52. The lift rail 20 and block 74 on the side of the hopper with wall 52 also slide along shaft 24. Each support block 74 has a ratchet tooth 70 pivotally mounted thereon so there are two ratchet teeth 70 on each side of the hopper. The same numerals will be used for the ratchet teeth and interacting parts, but it can be seen that two teeth 70 are on the left side and two are on the right side. Each ratchet tooth 70 has a hub 70A that is supported between flanges 78 on arms 76 that extend fore and aft from the center of the respective block 74. The hubs 70A are pivotally mounted on shafts 72 that are supported on flanges 78. The support block 74 that is adjacent wall 52 is slidably supported on the shaft 24 to the outside of the wall 52 on that side of the hopper 50.

Figure 6:
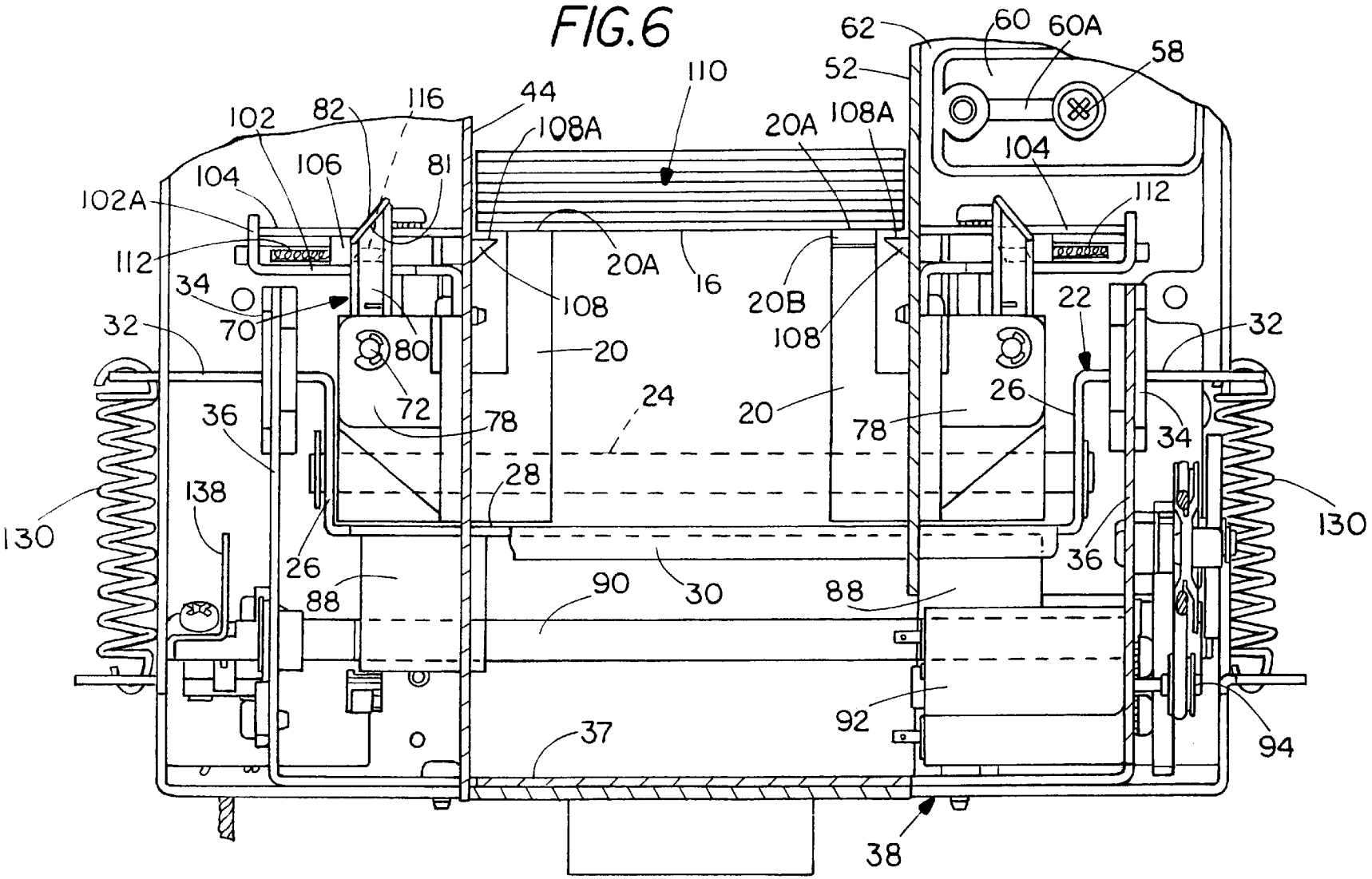
FIG. 6 is a view from an output end of the hopper similar to that shown in FIG. 4 with the card lift platform in a raised position.

Each of the ratchet teeth 70 has a support shank 80, and a ratchet head 81 with a wedge like or cam face surface 82, which, as can be seen in FIGS. 4 and 6 in particular are inclined relative to a vertical plane. The head 81 and face surface 82 extend laterally outward on each side of the shank 80 of the respective ratchet tooth.

The ratchet teeth 70 are each urged to rotate to a stopped position with a torsion spring 84. The stopped or retracted position prevents the ratchet teeth from moving counter-clockwise on the right-hand side or clockwise on the left-hand side as shown in FIGS. 4 and 6. In other words the heads 81 of the ratchet teeth 70 are prevented from pivoting in toward the respective adjacent side walls 44 and 52 of the hopper beyond the solid line positions shown. The ratchet teeth 70 can pivot in opposite directions, but will be loaded by spring 84 as they pivot.

Since the support blocks 74 move with the card lift support assembly 18, and are mounted on the shaft 24, the ratchet teeth 70 will move upwardly when the card support and lift assembly 18, including lift rails 20, are moved upwardly, as will be explained.

The upward movement of the card lift rails 20, and the card lift frame assembly 18, including the base or cam follower plate 28, and members 26 and 32, is controlled by a pair of cams 88, on opposite sides of the hopper. The cams 88 are drivably mounted onto a cam shaft 90, which is supported with bushing 96 on walls 36. The shaft 90 is driven from a drive motor 92 through a suitable belt and pulley and gear drive indicated generally at 94 in FIGS. 1, 4 and 6, and represented schematically in other figures.

The motor 92 can be a DC motor controlled as desired, from a controller 93 that also can be the printer controller.

The lift frame assembly 18, including blocks 74 and lift rails 20, is vertically slidably mounted relative to the walls 44 and 52, and can move up and down without interfering with the walls. The card lift frame assembly 18 is urged downwardly to its home position with springs 130 that are hooked between tabs 37A on base wall 37 and ends of flanges 32.

Figure 5:
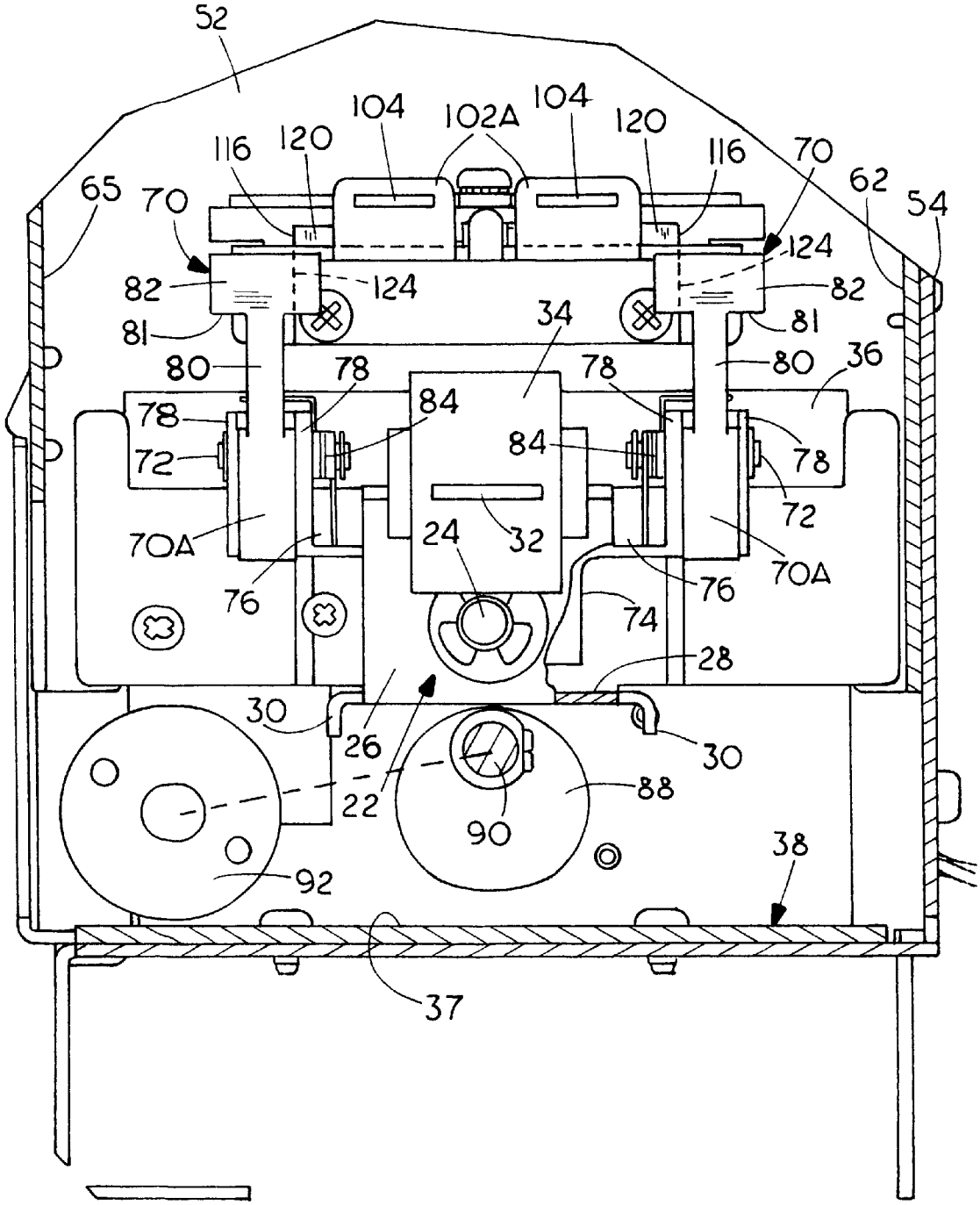
FIG. 5 is a side elevational view of the hopper of FIG. 1, with parts in section and parts broken away showing the lift in the position of FIG. 4.
Figure 7:
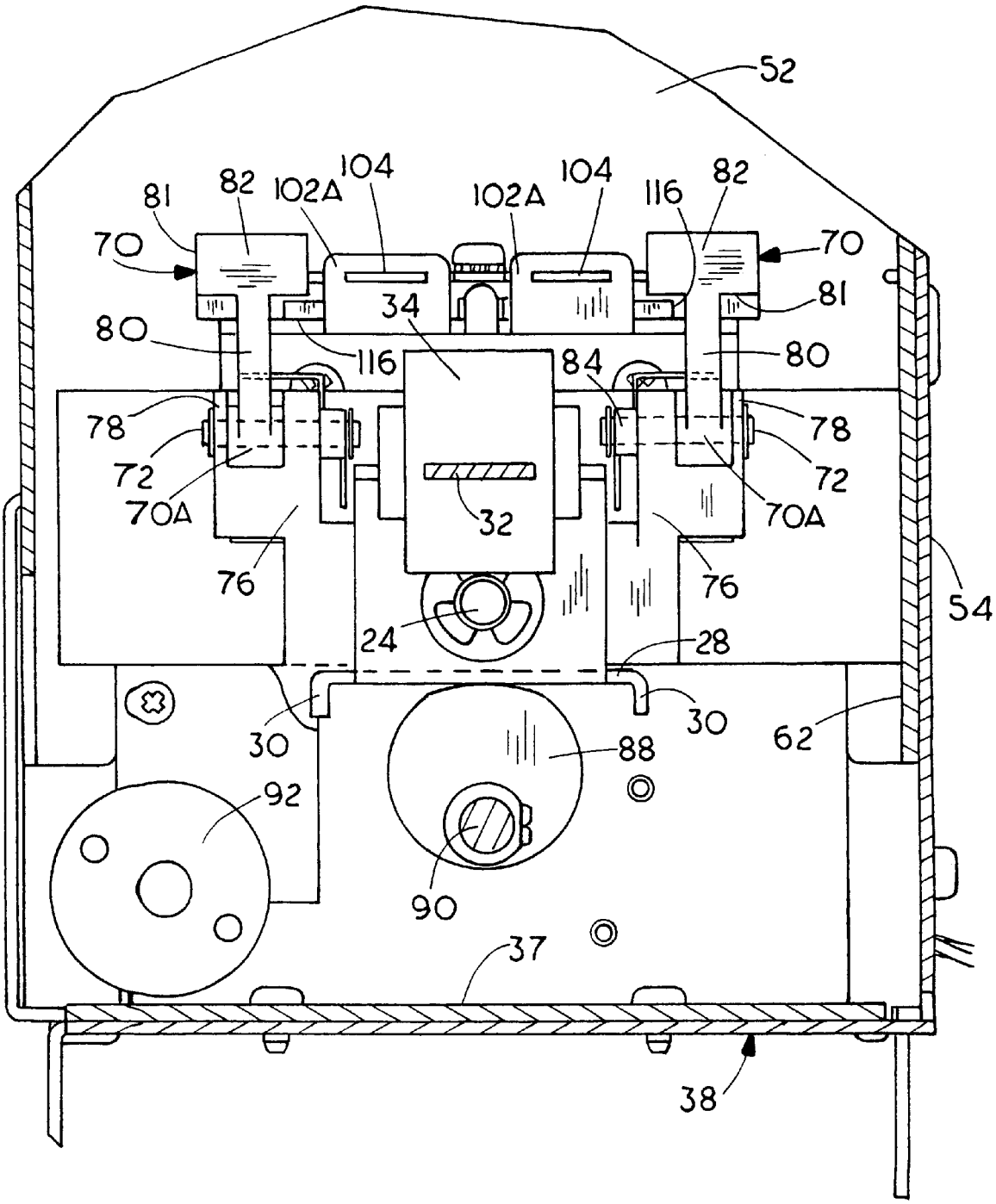
FIG. 7 is a side elevational view of the lift platform in the position shown in FIG. 5.

As the cam shaft 90 is rotated by motor 92, the cams 88 will turn, and it can be seen that from the home position shown in FIG. 5 to a fully raised position shown in FIG. 7, cam rotation of about 180° is necessary. Side walls 44 and 52 of the hopper 50 each carry a pawl assembly shown generally at 100, including a pawl support plate 102 that is fixed to the respective outer sides of the walls 44 and 52. Cover plates 104 is attached over the body members 106 that slide along the upper surface of the plates 102. The pawl bodies 106 each have an end pawl portion 108 that protrudes into the space between the walls 44 and 52. The pawl portions 108 are made to have a sufficient length in fore and aft direction, as can be seen in FIG. 2, for example, to support and hold very stably a stack of cards indicated generally at 110. The stack of cards 110 is supported on upper flat surfaces 108A of the pawl portions 108 that protrudes into the space between the hopper walls 44 and 52. The pawl portions 108 have tapered or wedge like lower surfaces that will permit the card 16 to cam the pawl portions outwardly if needed, as the card 16 is lifted.

The pawl bodies 106 are urged inwardly toward the interior, center plane of the hopper 50 with suitable springs 112, that are reacted against upright legs 102A of the support plates 102. The pawl bodies have actuator cam ears forming a type of a cam ear or lug indicated at 116 on each side of the respective pawl body 106. It can be seen in FIG. 4 for example, that the cam ear or lug 116 on each side of each pawl body 106 has a pair of inclined surfaces 118 and 120 on opposite sides thereof, and that the cam ear or lug 116 on each side of the respective pawl body 106 extends laterally less than the distance from an adjacent edge of the associated ratchet face surface 82 of the associated ratchet tooth 70 to the shank 80 for the associated ratchet tooth.

In other words, the outer end surfaces of the cam ears 116 are aligned with dotted lines shown at 124 in FIG. 5, for example, and it shows that the end surfaces will clear the shanks 80 when the ratchet cam face surface 82 has moved up past the respective tooth 120 as will be shown.

Figure 8:
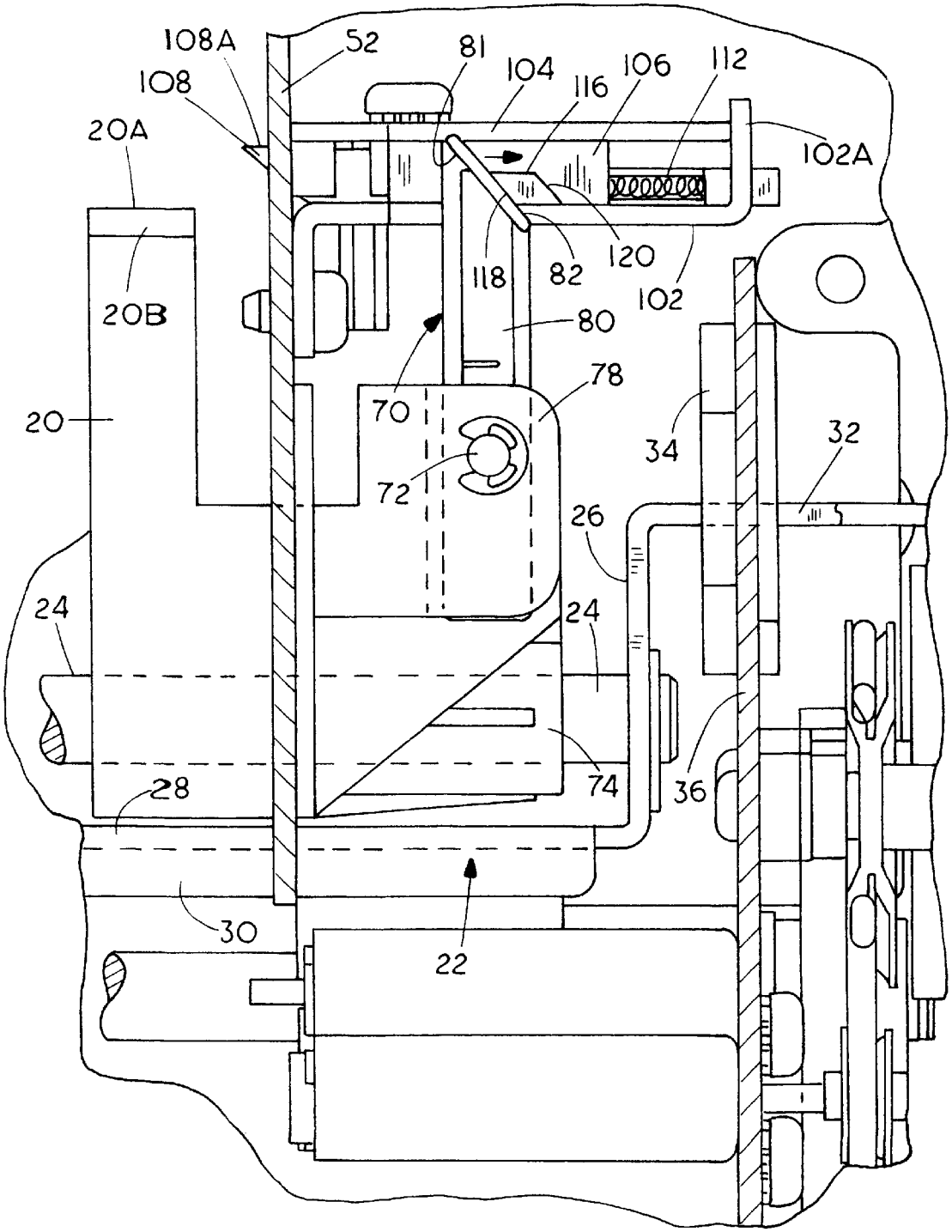
FIG. 8 is a fragmentary enlarged end elevational view of a portion of one side of the card lift and hopper in a partially raised position.
Figure 9:
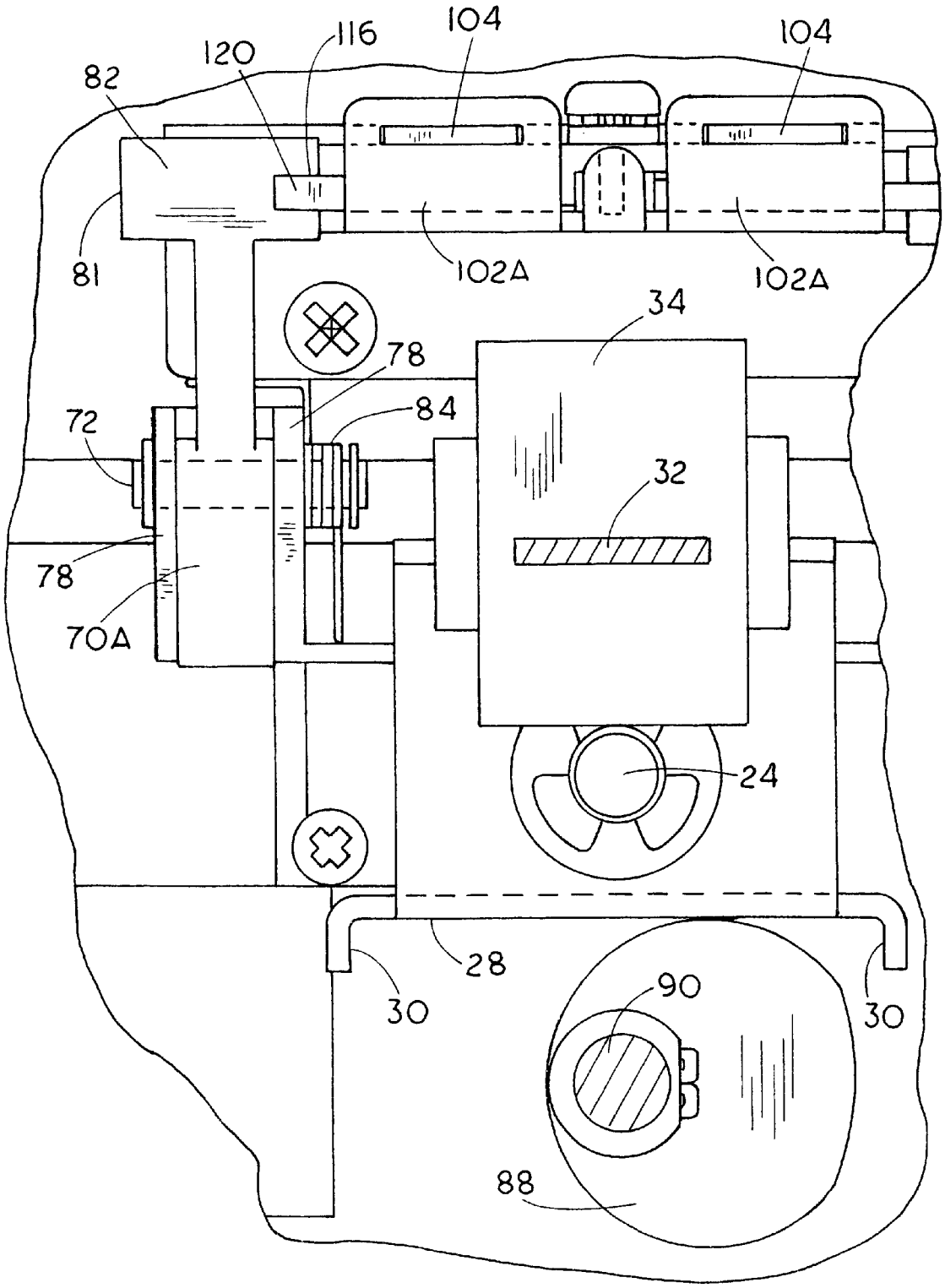
FIG. 9 is a fragmentary side elevational view of the portion of the hopper shown in FIG. 8.

When the ratchet teeth 70 move upwardly, as the card lift rails 20 are raised with the cam 88, an intermediate position is shown in enlarged views of FIGS. 8 and 9. In FIG. 8 it can be seen that the ratchet cam face or wedge surface 82 is riding against the inclined wedge surface 118 of the respective cam ear or lug 116, the pawl portion 108 is partially retracted, and does not protrude from the wall 52 as much as that shown in FIG. 4 for example. The pawl bodies 106 thus are then partially retracted and the springs 112 have been compressed. Because the ratchet teeth 70 are prevented from pivoting away from the walls 44 and 52, respectively, as shown in FIG. 8, the ratchet teeth will force the pawl bodies 106 and the pawl portions 108 to separate or move outwardly from the space between walls 44 and 52 until the ratchet cam face or wedge surfaces 82 no longer engage the respective cam ear surface 118. That is, the heads 81 move above the adjacent surface 118. When this occurs, shortly before the card lift is raised to its full up position as shown in FIGS. 6 and 7, the cam ears 106 will slip off the lower edges of the portions of the surface 82 that extends outwardly from the shanks 80. Because the cam ears 116 are short enough that they will clear the shanks 80, the springs 112 will force the ratchet bodies 106 inwardly, and the position that is shown in FIGS. 6 and 7 will be reached. It can be seen in FIG. 7 that the surface 82 is above the cam ear 116 on each side of the respective pawl body 106. Also, it can be seen in FIG. 6 that the pawl portions 108 have extended inwardly under the card 16 that has been lifted by the card lift surfaces 20A.

It is thus evident that the stack 110 of cards, now including the new card 16, will be supported on the pawl portion surfaces 108A as the card lift rails 20 lower, as the cam shaft 90 rotates and springs 130 pull the frame assembly 18 down. It should be noted that as the card lift rails 20 are moved upwardly to the position shown in FIG. 6, the card 16 will engage the lower card in stack 110 and the entire stack 110 will be lifted off the pawl portions 108.

When the card lift rails 20 are lowered, as the cams 88 continue to rotate, the cam ears 116 will engage the end portions of head members 81 and the underside of the end members 81 at the outer edge portions that stick out laterally beyond the shanks 80, will ride along the surfaces 120 of the cam ears 116. Because the ratchet teeth 70 can pivot outwardly away from the walls 44 and 52, the ratchet teeth will pivot to permit heads 81 to slide past the cam ear 116 and return to their normal stopped position under the urging of the torsion springs 84. Again, if one looks at the dotted alignment lines 124 in FIG. 5, it can be seen that the outer end surface of the cam ears 116 will ride against the outer ear portions of the end members 81 and permit the ratchet teeth 70 to pivot out of the way so that the pawl bodies 106 can go back to their home positions and thus are reset automatically.

It can be seen that using a rotating cam 88 provides a very smooth action. The cams 88 ride against the under surface of the cross plate 28, and thus there is a substantial surface area to insure that excessive wear does not occur. A cam position sensor 136 is mounted on the frame 38, and a flag 138 rotates with shaft 90 to permit sensing one or more positions of cams 88, the home position and the full up position, if desired.

As stated, the card lift frame assembly 18 is urged to its home position with the springs 130. The springs 130 are tension springs that can be of any desired strength, but will continue to provide a load between the cams 88 and the under surface of the cross wall 28. The card lift rails 20, and the top surfaces 20A are low friction material such as Teflon or Delrin, so that the cards 16 slide easily without abrasion or wear, and thus can be moved quickly into position on the rails 20. Then the cams 88 operate to lift and lower the card that has been placed on the card lift rails and form the stack 110 that is above the new card 16.

When the stack of cards 110 is up to the top of the hopper, the sensor 48 provides a signal to warn the operator, or the signal can be provided to controller 93 to cause other operations to take place, such as shutting off the printer until the card stack 110 has been removed.

Again, the side wall 52 of the hopper is easily slid laterally for adjustment, having the sliding guides on the upright wall flange 54, and the bushing 68 sliding on the shaft 66. A wall 52 is adjusted laterally, the right-hand (in FIGS. 4 and 6) card lift rails 20, the ratchet, and the like will also move laterally and slide on the shaft 24 with wall 52 to permit this adjustment.

The position of the card lift rails 20 about the axis of the shaft 24 is controlled by the upper surface of the wall 28, which provides a small amount of clearance.

Although the present invention has been described with reference to preferred embodiments, workers skilled in the art will recognize that changes may be made in form and detail without departing from the spirit and scope of the invention.

What is claimed is:

1. A stacker for identification cards comprising a hopper having a pair of side walls, said hopper having an opening at one end thereof to receive cards to be stacked, a card lift having an upper surfaces for supporting a card, a lift member positioned to operably lift and lower the upon actuation, and a pair of pawls, one extending through each of the side walls and positioned above the card lift in a home position of the card lift, said card lift being movable to a raised position such that the plane of the upper surface is above the pawls, and a pair of ratchets for retracting the pawls during movement of the card lift from a home position to a raised position to provide clearance along the side walls for a card on the card lift to move upwardly above the pawls, said pawls being spring loaded, and being released to move inwardly when the card lift rails have moved to a selected raised position wherein said pawls have cams thereon each of the ratchets engaging the respective cam to move the pawls outwardly from the hopper as the card lift is moved to lift a card said ratchets having a clearing position that releases the respective cam when the card lift has reached the raised position.

2. The stacker of claim 1 and a spring loading said pawls inwardly toward a center plane of said hopper between the side walls.

3. The stacker of claim 1, wherein said card lift is mounted on a support having a base wall that extends laterally across the hopper, said base wall being below said card lift, and said lift member comprising a rotatable lift cam engaging said base wall on a lower side of the base wall.

4. The stacker of claim 1, wherein one of said hopper side walls is slidably mounted relative to the other, the card lift comprising a pair of spaced lift rails, one of the lift rails, and one ratchet and pawl associated with the one hopper side wall being slidably mounted to move with said one side wall to permit adjusting the width of the hopper for different size cards.

5. The stacker of claim 4, wherein said one side wall has a bushing at an upper end thereof, said bushing being slidably mounted on a shaft fixed to the other side wall and spanning a space between the side walls.

6. A stacker for identification cards comprising a hopper having a pair of side walls, said hopper having an opening at one end thereof to receive cards to be stacked, a card lift having an upper surface for forming a plane for supporting a card, a lift member positioned to operably lift and lower the card lift upon actuation, and a pair of bawls, one extending through each of the side walls and positioned above the card lift rails in a home position of the card lift, said card lift being movable to a raised position such that the plane of the upper surface is above the pawls, a ratchet for retracting the pawls during movement of the card lift from the home position to the raised position to provide clearance along the side walls for a card on the card lift to move upwardly above the bawls, said pawls being spring loaded, and being released to move inwardly when the card lift has moved to the raised position, said pawls each comprising a pawl body slidably mounted on an exterior of a respective hopper side wall, each pawl body including a pawl portion that extends inwardly into a space between the side walls of the hopper from one of the side walls, the ratchet retracting the pawl bodies so that the pawl portions do not extend a substantial distance inwardly from inner surfaces of the respective side walls of the hopper, said ratchet comprising a pivotally mounted ratchet tooth for each pawl, each ratchet tooth having a shank and a head, the head having a portion extending laterally from the shank a selected distance, a cam on each respective pawl body in at least partial registry with the laterally extending head portion of the respective ratchet tooth head, said ratchet teeth heads having an inclined surface mating with an inclined surface on the respective cam, and as the card lift is moved upwardly, the ratchet teeth also moving upwardly to a position where the laterally extending portions of the heads of the ratchet teeth engage the cams of the pawls and first retract the respective pawl and then slip past the respective cam and releases the respective pawl body from outward movement, and the spring load on the pawls then urging the pawl bodies inwardly toward a center plane of the hopper.

7. The stacker of claim 6, wherein said ratchet teeth are spring loaded and can pivot in a direction to slide along a surface of the cam on an opposite side of the respective cam from the actuating surface for retracting the pawls when the lift rails and ratchet teeth are lowered, and a second spring load moving the ratchet teeth back to an operable position when the heads of the ratchet teeth clear the respective cam as the card lift and ratchet teeth are lowered.

8. The stacker of claim 6, wherein said cam ears have parallel front and rear surfaces, the front surface engaging the head of the respective ratchet tooth as the ratchet tooth moves upwardly, a surface of the head and the front surface of the cam ear being inclined relative to a vertical direction of movement of the rails to move the pawls outwardly from the hopper.

9. The stacker of claim 6, wherein one of the pawl bodies is mounted on a pawl support plate, said pawl support plate being connected to the movable side wall.

10. A stacker for identification cards comprising a hopper having a pair of side walls, said hopper having an opening at one end thereof to receive cards to be stacked, a card lift having an upper surface for supporting a card, a lift member positioned to operably lift and lower the card lift upon actuation, and a pair of pawls, one extending through each of the side walls and positioned above the card lift in a home position of the card lift, said card lift being movable to a raised position such that the plane of the upper surface is above the pawls, a ratchet for retracting the pawls during movement of the card lift from a home position to the raised position to provide clearance along the side walls for a card on the card lift to move upwardly above the pawls, said pawls being spring loaded and being released to move inwardly when the card lift has moved to a selected raised position, and a sensor adjacent a top of the hopper for sensing when a stack of stackable items reaches a preselected level.

11. An output hopper and stacking assembly for stackable items having a defined shape and periphery, at least a pair of side walls defining a space therebetween for receiving the stackable items, a lift assembly having a home position and a raised position, said lift assembly including a support surface for supporting the stackable item in a home position, and being operable to lift the stackable items as guided along the side walls to a raised position and movable back to the home position along a planar path, a pair of retractable pawls, one at each side wall, said retractable pawls moving to an inward position to underlie the stackable item with the lift assembly in the raised position, and the retractable pawls clearing the lift assembly support surface in the inward position and engaging and holding the stackable item as the lift assembly support surface moves to the home position.

12. The hopper and stacking assembly of claim 11, wherein said lift assembly comprises a pair of lift rails having the support surface, said lift rails being adjacent the respective side walls, and one of the lift rails being slidably mounted relative to the other to move with the movable side wall.

13. The hopper and stacking assembly of claim 12 and a ratchet mechanism having a pair of ratchet teeth, one for each pawl, that engage a cam portion of the pawl on the respective sides of the hopper, the ratchet teeth moving the pawls outwardly as the lift assembly moves toward its raised position, and clearing the cam portion in the raised position to release the pawls to move inwardly.

14. The hopper and stacking assembly of claim 13, wherein the ratchet teeth can pivot in a direction away from the respective side walls, and the ratchet teeth each having a surface that engages a second surface of the respective cam portion to pivot the ratchet teeth to move past the cam ears and reset the ratchet teeth into an operable position as the lift assembly is moved to its home position.

15. A stacker for identification cards comprising a hopper having a pair of side walls, said hopper having an opening at one end thereof to receive cards to be stacked, a card lift having an upper surface for supporting a card, a lift member positioned to operably lift and lower the card lift upon actuation, and a pair of pawls, one extending through each of the side walls and positioned above the card lift in a home position of the card lift, said card lift being movable to a raised position such that the plane of the upper surface is above the pawls, a ratchet for retracting the pawls during movement of the card lift from a home position to the raised position to provide clearance along the side walls for a card on the card lift to move upwardly above the pawls, said pawls being spring loaded and being released to move inwardly when the card lift has moved to a selected raised position, wherein said card lift is mounted on a support having a base wall that extends laterally across the hopper, said base wall being below said card lift, and said lift member comprising a rotatable cam on a lower side of the base wall for lifting and lowering the base wall and card lift.

16. The stacker of claim 15 and springs for urging said card lift and said base wall against the cam and toward a home position.

17. The stacker of claim 15, wherein said actuator cam is mounted on a rotating cam shaft, and a sensor on the shaft for sensing the position of the shaft when the card lift are in a home position.

18. The stacker of claim 17, wherein there are two actuator cams mounted onto the cam shaft at axially spaced locations, both of the actuator cams engaging a surface of the base wall.

19. The stacker of claim 15, wherein the card lift comprises a pair of spaced lift rails, on adjacent each side wall, a frame assembly for supporting the lift rails, said frame assembly including the base wall extending laterally below the hopper, a pair of upright walls on the exterior of the hopper joined to the base wall, and a cross shaft supported between the upright walls, said lift rails being mounted on the cross shaft, and at least one of said lift rails being slidably mounted on the cross shaft to permit the spacing between the lift rails to be changed.

20. The stacker of claim 19, wherein said at least one lift rail is associated with a movable side wall of the hopper, said movable side wall being slidably guided relative to a hopper frame and the cross shaft for adjustable movement relative to the other of the side walls of the hopper to change the spacing between the side walls.

* * * * *

UNITED STATES PATENT AND TRADEMARK OFFICE

CERTIFICATE OF CORRECTION

PATENT NO. : 6,199,857 B1
DATED : March 13, 2001
INVENTOR(S) : Brent D. Lien

It is certified that error appears in the above-identified patent and that said Letters Patent is hereby corrected as shown below:

Column 6,
Line 20, cancel "surfaces" and insert -- surface --.
Line 21, after "the" insert -- card lift --.
Line 35, after "card" insert -- , --.
Lines 62, cancel "bawls" and insert -- pawls --.

Column 7,
Line 3, cancel "bawls" and insert -- pawls --.
Line 24, cancel "releases" and insert -- release --.
Line 39, after "head" insert -- member --.

Signed and Sealed this

Sixteenth Day of April, 2002

*Attest:*

*Attesting Officer*

JAMES E. ROGAN
*Director of the United States Patent and Trademark Office*